US009320410B2

(12) United States Patent
Delle et al.

(10) Patent No.: US 9,320,410 B2
(45) Date of Patent: Apr. 26, 2016

(54) DISHWASHING MACHINE

(75) Inventors: Daniel Delle, Bächingen (DE); Bernd Heisele, Sontheim (DE); Bruno Reiter, Kösingen (DE); Roland Rieger, Rainau (DE)

(73) Assignee: BSH Hausgeraete GmbH, Munich (DE)

( * ) Notice: Subject to any disclaimer, the term of this patent is extended or adjusted under 35 U.S.C. 154(b) by 1247 days.

(21) Appl. No.: 13/260,576

(22) PCT Filed: Mar. 16, 2010

(86) PCT No.: PCT/EP2010/053348

§ 371 (c)(1),
(2), (4) Date: Sep. 27, 2011

(87) PCT Pub. No.: WO2010/112330

PCT Pub. Date: Oct. 7, 2010

(65) Prior Publication Data

US 2012/0017944 A1 Jan. 26, 2012

(51) Int. Cl.
*A47L 15/46* (2006.01)
*A47L 15/00* (2006.01)

(52) U.S. Cl.
CPC ..... *A47L 15/0015* (2013.01); *A47L 15/0057* (2013.01); *A47L 2501/34* (2013.01); *A47L 2601/02* (2013.01)

(58) Field of Classification Search
None
See application file for complete search history.

(56) References Cited

U.S. PATENT DOCUMENTS

| | | | | |
|---|---|---|---|---|
| 5,411,042 | A * | 5/1995 | Suzuki et al. | 134/57 D |
| 5,947,135 | A * | 9/1999 | Sumida | A47L 15/0002 134/103.1 |
| 2006/0096615 | A1 | 5/2006 | Elick et al. | |
| 2007/0094811 | A1 | 5/2007 | Sechelmann | |
| 2008/0149148 | A1 * | 6/2008 | Woo et al. | 134/104.1 |
| 2011/0126869 | A1 | 6/2011 | Heisele et al. | |

FOREIGN PATENT DOCUMENTS

| | | | |
|---|---|---|---|
| DE | 19515025 | A1 | 10/1996 |
| EP | 0524102 | B1 | 4/1997 |
| EP | 0766945 | A2 | 4/1997 |
| GB | 1522153 | A | 8/1978 |
| WO | 9720493 | A1 | 6/1997 |
| WO | 2008077970 | A1 | 7/2008 |

OTHER PUBLICATIONS

International Search Report PCT/EP2010/053348.
Report of Examination DE 10 2009 002 147.7.

* cited by examiner

*Primary Examiner* — Michael Kornakov
*Assistant Examiner* — Ryan Coleman
(74) *Attorney, Agent, or Firm* — James E. Howard; Andre Pallapies

(57) ABSTRACT

A dishwashing machine, particularly a household dishwashing machine, at least having one wash tub for the accommodation of receiving items to be washed that can be cleaned at least during one step of pre-rinsing and/or washing by cleaning agent additive. According to the invention, there is a wash tub cleaning program having lower item cleaning power than in the pre-rinsing and/or washing step, whereas the at least partially inner surfaces of the wash tub can be acted upon by fluid in order to remove grease deposits at least in the wash tub.

37 Claims, 2 Drawing Sheets

DISHWASHING MACHINE

BACKGROUND OF THE INVENTION

The invention relates to a dishwashing machine, particularly a household dishwashing machine, at least having a washing compartment for accommodating items to be cleaned which are able to be cleaned at least during a cleaning step by adding cleaning agent.

Reducing energy consumption in dishwashing machines, especially household dishwashing machines, is of great importance. A reduction in energy consumption can be achieved by the use of so-called low-temperature programs, for example in conjunction with suitable low-temperature cleaners in which liquid, i.e. water, to which cleaning agent has been added if necessary, is heated up to a maximum temperature of 50° C. for example. However the continuing use of these type of low-temperature programs results in fatty contaminant films being able to adhere to the interior of the washing compartment. To remove such fatty contaminant films a special machine cleaner can be used which however also requires a special cleaning cycle of an otherwise unloaded dishwashing machine, with operation at at least 65° C. being necessary in this case. As an alternative, instead of a low-temperature program for reducing fatty contaminant films, a normal or high-temperature program, in which liquid is heated up to a maximum temperature of around 65° C. or around 75° C. in an intensive program for example can be selected. In such cases the selection can be made by an operator manually or can be made automatically by the dishwashing machine itself. However, like operating an otherwise empty dishwashing machine, this increases the energy requirement.

One option for preventing soiling building up, especially in the door area of a dishwashing machine, before it can occur is proposed in US 2006/0096615 A1. In order to ensure that the said soiling is flushed out after each wash cycle, the circulation pump is stopped for a certain time after a cleaning section, so that the liquid level within the dishwashing machine rises to a specific level as a result of the flowback of washing liquor. Ultimately this flushes soiling into the area of an outlet and in this way it can be drained out of the dishwashing machine. The washing liquor is cooled off again however in the sections in which the circulation pump is at a standstill so that a renewed heating of said liquor has to be undertaken subsequently.

BRIEF SUMMARY OF THE INVENTION

The object of the invention is thus to further develop a dishwashing machine such that it is possible to clean the washing compartment with the minimum possible energy requirement.

The object is achieved based on a dishwashing machine, particularly a household dishwashing machine, featuring at least one washing compartment for accommodating items to be cleaned, which is able to be cleaned by adding cleaning agent at least during a pre-rinsing and/or cleaning step.

According to the invention there is provision for a washing compartment cleaning program with a lower dishwashing power than in the pre-rinsing and/or cleaning step to be provided, during which at least at times inner surfaces of the washing compartment are able to have liquid applied to them in order to remove fat deposits at least in the washing compartment. This means that the washing compartment cleaning program has a reduced cleaning power in relation to items to be cleaned. By contrast with operation with a normal high-temperature program, the washing compartment cleaning program is designed so that essentially only the side walls, the rear wall and the inner door of the washing compartment as well as a filter covering the pump sump, which prevents particles penetrating into the circulation pump and being able to cause a blockage there, are cleaned, while the liquid is not applied to the items to be washed and there is thus also no heating up of the items to be washed. Thus the washing compartment cleaning program allows energy-efficient cleaning of the washing compartment and also of the filter so that the filter is prevented from becoming blocked by fatty deposits.

There is provision in a development for the washing compartment cleaning program to be a part step of a washing program having a step involving pre-rinsing and/or cleaning with the addition of cleaning agent. Such a washing program can typically feature the steps pre-rinsing, cleaning, intermediate rinsing, final rinsing and drying. In such cases items to be washed have liquid, for example water, without added cleaning agent applied to them during the pre-rinsing step, while in the cleaning step liquid with added cleaning agent which is heated up to a maximum temperature, for example 50° C., is applied to the items to be washed. In the intermediate rinsing step non-heated water without added cleaning agent is applied to the items to be washed, while in the final rinsing step the cleaned items have water with added rinsing agent acting as a wetting agent applied to them and are subsequently dried during the drying step. The fact that the washing compartment cleaning program is a part step of a pre-rinsing and/or cleaning step with the addition of cleaning agent enables the cleaning of the washing compartment to be undertaken during a normal washing program execution for cleaning items to be washed. Thus no additional washing program has to be run in an otherwise empty dishwashing machine, so that the overall energy requirement is reduced. At the same time this makes it possible to combine the cleaning of a washing compartment with the cleaning of items to be washed, which likewise also reduces the quantity of time required as well as the energy consumption.

In this case there is provision in a development for the washing compartment cleaning program to be executed before the pre-rinsing and/or cleaning step. If for example a pre-rinsing step is provided in which heated liquid is applied to the items to be cleaned in order to achieve increased cleaning power compared to normal pre-rinsing with application of non-heated liquid to the items to be washed, the washing compartment cleaning program can be a first step of a wash program including a plurality of steps. As an alternative there is provision for the washing compartment cleaning program to be executed before the step involving cleaning with the addition of the cleaning agent.

In a development there is provision for a cleaning agent to be able to be dissolved during the washing compartment cleaning program. This improves the cleaning of the washing compartment through the cleaning effect of the dissolved cleaning agent, whereby through corresponding activation of a dispensing device of the dishwashing machine for dispensing a cleaning agent, the cleaning agent is released into the washing compartment at the beginning of the washing compartment cleaning program.

In another development there is provision for a cleaning agent to be dissolved after the washing compartment cleaning program, i.e. during the subsequent cleaning step for example. In this case the washing compartment is cleaned without the support of the cleaning effect of the cleaning agent, by only using heated water for example. Regardless of whether the cleaning agent is released after the washing compartment cleaning program, the period of dissolving the cleaning agent can extend from the start of the washing compartment cleaning program into the cleaning step itself.

There is also provision according to the invention for wetting of items to be washed with liquid to be less during the washing compartment cleaning program than during the pre-rinsing and/or cleaning step. This makes a significant energy saving possible, since during the washing compartment cleaning program no energy or a smaller quantity of energy than during the cleaning step has to be expended for heating up items to be washed, since no heated liquid or only a small quantity is applied to items to be washed. In this way an associated cooling down of the circulated liquid, with a deterioration in the cleaning effect during the removal of the fat deposits is avoided.

To this end there is provision in a development for a liquid circulated during the washing compartment cleaning program to be at least routed at times along a path extending along a first section essentially parallel to a roof of the washing compartment and along a second section essentially parallel to side walls, rear wall and/or the door of the washing compartment of the dishwashing machine. Thus liquid is routed during the washing compartment cleaning program along the roof and the side walls, the rear wall and the inner door past crockery baskets provided in the washing compartment to accommodate items to be cleaned.

There is provision in a development for a plurality of cleaning devices arranged one above the other at a number of levels to be provided for applying liquid to items to be washed, with the topmost spray device able to be operated during the washing compartment cleaning program. The spray devices arranged in levels can involve a lower and upper spray arm which are assigned to a lower or upper crockery basket respectively as well as a topmost spray device embodied as a shower head which is arranged on the roof of the spray container. In such cases the shower head is operated so that the circulated liquid, on exit from the shower head, is essentially routed in parallel to the roof of the washing compartment.

In a further development there is provision for a first quantity of liquid to be circulated during the washing compartment cleaning program and for a second quantity of liquid to be circulated during the pre-rinsing and/or cleaning step, with the first quantity of liquid being smaller than the second quantity of liquid. This makes it possible for further energy to be saved during the washing compartment cleaning program, since only a small quantity of liquid has to be circulated. This can involve a quantity of 2 to 3 liters.

In such cases there is provision in a development for the first quantity of liquid to be able to be circulated at a higher pressure for at least part of the time than the second quantity of liquid circulated at a lower, second pressure. The increased pressure enables the removal power during circulation of the first amount of liquid to be increased as a result of the greater kinetic energy, whereby in particular no regard has to be paid to undesired damage to the sensitive items to be washed, since the first quantity of liquid does not come into contact with the items to be washed.

In a further development a circulation pump is provided for circulating liquid which is at least able to be operated at a high and a low speed, with the circulation pump able to be operated for at least some of the time during the washing compartment cleaning program at the high-speed and for at least for some of the time during the pre-rinsing and/or cleaning step at the low speed. Thus, simply by changing the speed of the circulation pump, the higher first pressure and the low second pressure are able to be set. In addition liquid can be guided in this way in a simple manner along the first section of the path.

There is further provision in a development for a first quantity of liquid to be heated up during the washing compartment cleaning program to a first maximum temperature which is higher than a second maximum temperature to which a second quantity of liquid is able to be heated up during the pre-rinsing and/or cleaning step. This again allows a marked reduction in energy required, since only the first quantity of liquid for cleaning the washing compartment is heated up to the higher, first maximum temperature, while the second quantity of liquid for cleaning items to be washed is heated up to the second, lower maximum temperature. It is especially advantageous and energy-saving for the first quantity of liquid which is heated up to a first, higher maximum temperature to be smaller than the second quantity of liquid which is used during the pre-rinsing and/or cleaning step.

There is provision here in a development for the temperature difference between the maximum temperatures to be at least essentially between 5° C. and 50° C., preferably between 10° C. and 25° C. An effective removal of fat deposits is thus guaranteed and at the same time energy-saving operation is provided with cleaning of items to be washed.

There is provision in a further development for the first, smaller quantity of liquid to be contained in the second, larger quantity of liquid. This means, during the execution of a wash that comprises at least one washing compartment cleaning program and a subsequent pre-rinsing and/or cleaning step, first of all the smaller, first quantity of liquid is heated up to a first, higher maximum temperature and at the beginning of the cleaning step fresh water is added from a domestic water supply network or a reservoir of the dishwashing machine, until the dishwashing machine has been filled with the second quantity of liquid, for example 1 to 3 liters. In such cases no heating up of the second quantity of liquid in order to achieve the cleaning effect needed during the cleaning step is required since the mixing temperature produced from the first smaller quantity of liquid and the second quantity of liquid provides the lower maximum temperature of typically 50° C. Thus the energy expended in the washing compartment cleaning program for heating up the first smaller quantity of water to the first higher maximum temperature is used again in the subsequent cleaning step for cleaning items to be cleaned, so that an especially energy-saving operation is made possible or pre-rinsing with heated liquid and thereby increased cleaning power is made possible without requiring additional energy.

The object is also achieved by a method for operating a dishwashing machine, especially a household dishwashing machine, during which items to be washed arranged in a washing compartment are cleaned at least during a pre-rinsing and/or cleaning step with added cleaning agent, whereby during a washing compartment cleaning program with a lower dishwashing power than in the pre-rinsing and/or cleaning step, fat deposits in the washing compartment are removed by applying liquid to the items to be washed.

Developments of the invention are specified in the subclaims.

BRIEF DESCRIPTION OF THE DRAWINGS

The invention is explained below with reference to a drawing, in which.

DETAILED DESCRIPTION OF EXEMPLARY EMBODIMENTS OF THE PRESENT INVENTION

Figure 1:
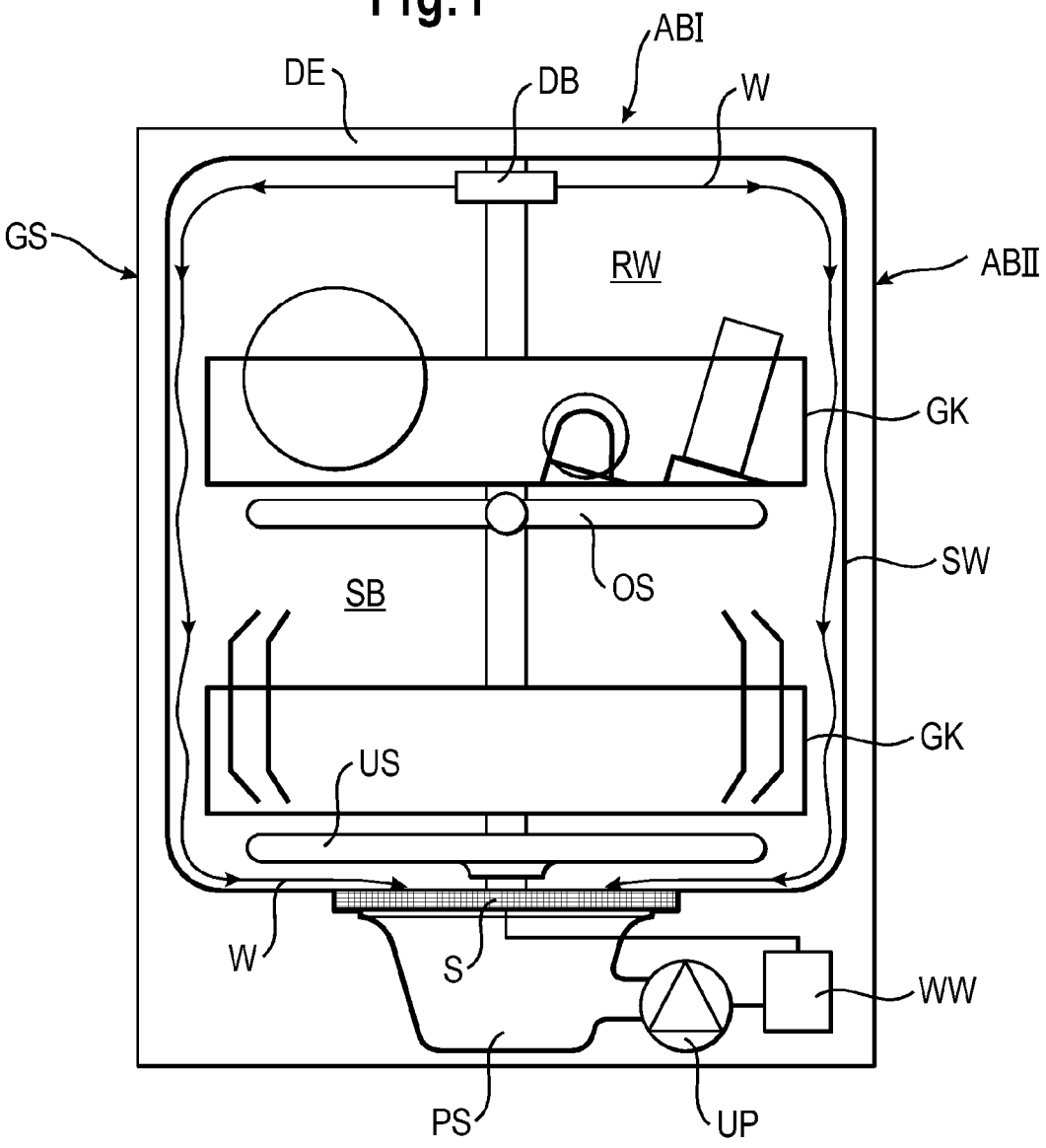
FIG. 1 shows a schematic diagram of an exemplary embodiment of an inventive dishwashing machine.

The reader is first referred to FIG. 1.

Shown in the present exemplary embodiment is a dishwashing machine GS embodied as a household dishwashing machine. The dishwashing machine GS features a washing compartment SB for accommodating items to be cleaned. Pull-out crockery baskets GK are arranged in the washing compartment SB for this purpose. To load and unload it, the washing compartment SB can be opened or closed by means of a door formed from an outer door and an inner door (not shown).

Assigned to the lower of the two crockery baskets GK is a rotating lower spray arm US, whilst the upper crockery basket GK is assigned an upper rotating spray arm OS. Furthermore a spray device embodied as a shower head DB is arranged on the roof DE of the washing compartment SB. To circulate liquid, e.g. water, to which cleaning agent or rinsing agent can be added, the lower spray arm US and also the upper spray arm OS as well as the shower head DB are connected in a liquid circuit with a circulation pump UP which sucks up the liquid collecting in the pump sump PS of the dishwashing machine GS and routes it to the lower spray arm US, the upper spray arm OS and/or the shower head DB. To enable either the lower spray arm US, the upper spray arm OS or the shower head DB to be supplied individually or in any given groups or all at the same time with liquid, a water switch WW is provided between the circulation pump UP and the supply lines (not shown). A filter S is provided between the washing compartment SB and the pump sump PS, with which particles can be kept away from the circulation pump UP and it can be ensured in this way that such particles cannot cause a blockage of the circulation pump UP. For selected control of the lower spray arm US, the upper spray arm OS or the shower head DB a control device (not shown) is provided, which controls both the circulation pump UP and also the water switch WW during the operation of the dishwashing machine.

Figure 2:
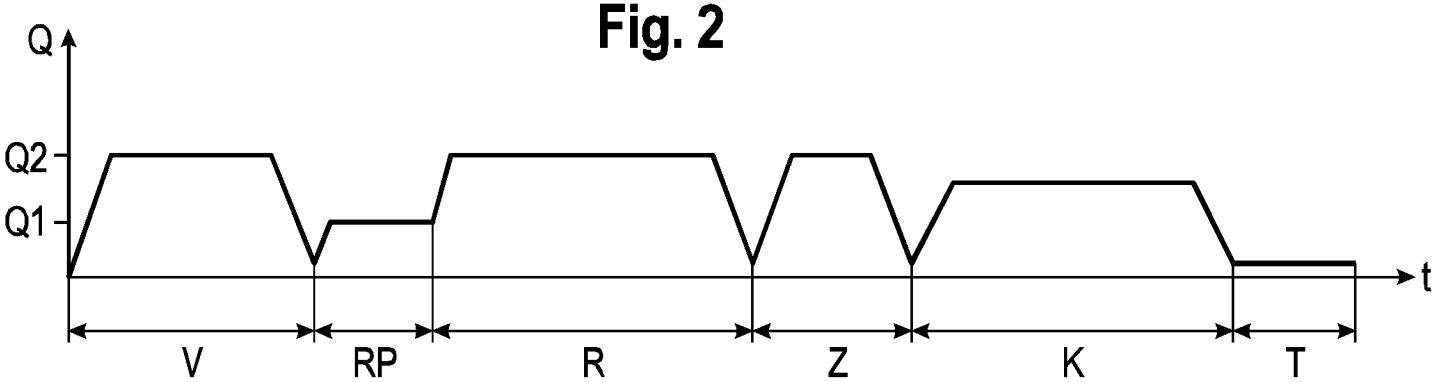
FIG. 2 shows a schematic diagram of a filling sequence during operation of an inventive dishwashing machine.

The reader is now additionally referred to FIG. 2.

A wash program for cleaning items to be washed normally features the steps pre-rinsing V, cleaning R, intermediate rinsing Z, final rinsing K and drying T. In this case the soiled items to be washed have unheated liquid without cleaning agent applied to them during the pre-rinsing V, so that coarse soiling can be rinsed off by the mechanical effect of the liquid or of the water. This is followed by the cleaning step R in which the items to be washed are cleaned with heated liquid and with the addition of cleaning agent, whereby the liquid can typically be heated to a maximum temperature of around 50° C.

This is followed by an intermediate rinsing step Z during which the cleaned items have unheated liquid without added cleaning agent applied to them. There now follows a final rinsing step during which for example the cleaned items have rinsing agent, i.e. water with added wetting agents, applied to them, with the liquid able to be heated up for example to temperatures of 60° C. to 70° C., in order to prepare for the subsequent drying step T. In the last step, drying T, the cleaned items are dried, being dried by their own heat for example. As a variation there can be provision for omitting individual steps in variants of a washing program, such as the pre-rinsing step V for example, executing individual steps multiple times, e.g. twice, or also applying heated liquid during the pre-rinsing V to items to be cleaned in order to increase the cleaning power.

To remove fat deposits in the washing compartment SB of the dishwashing machine GS, especially on the side walls SW on the rear wall RW and on the inner door (not shown) of the washing compartment SB, but also to remove fat deposits from the filter S, a washing compartment cleaning program RP is provided.

The washing compartment cleaning program RP is executed after the pre-rinsing V and before the cleaning step R. This means that with a dishwashing machine GS with this washing compartment cleaning program RP it is simultaneously possible to clean and to dry items to be washed and also to remove fatty deposits in the washing compartment SP and also from the filter S.

To this end a quantity of liquid Q2, for example 4 to 5 liters, is circulated during the pre-rinsing V, by operating the circulation pump UP for example, and unheated liquid, for example water is applied, with the lower spray arm US, the upper spray arm OS and/or the shower head DB, to the items to be washed arranged in the crockery baskets GK in order to remove coarse soiling.

At the end of the pre-rinsing V the quantity of liquid Q2 is conveyed by a drain pump (not shown) into a domestic waste water disposal network. For executing the subsequent washing compartment cleaning program RP the dishwashing machine GS is now filled with a quantity of water Q1, for example 2 to 3 liters of water. The water switch WW is also placed by a control device into a position such that only the shower head DB will be supplied with liquid, while the lower spray arm US and the upper spray arm OS will not be supplied with liquid and as a result do not rotate during the dishwasher compartment cleaning program RP. In this case the circulation pump UP is operated during the dishwasher compartment cleaning program RP at a speed which is higher than the speed with which the circulation pump UP is operated during the pre-rinsing step V and/or the subsequent cleaning step R. Thus the quantity of liquid Q1 is circulated during the dishwasher compartment cleaning program RP at a higher pressure than during the pre-rinsing step V and/or cleaning step R.

The result achieved by this is that the quantity of liquid Q1 moves along a path W during the washing compartment cleaning program RP which is formed by a first section ABI and the second section ABII. In this case the path W runs in the area of the first section ABI essentially parallel to the roof DE of the washing compartment SB, while the path in the second section ABII runs essentially parallel to the two side walls SW, the rear wall RW as well as the inner door (not shown), so that the quantity of liquid Q2 does not come into contact with the items to be washed arranged in the crockery baskets GK.

To increase the cleaning power during the dishwasher compartment cleaning program RP there is provision for the quantity of liquid Q2 to be heated up, into a temperature of 60° C. to 80° C. for example. In this case the result of guiding the quantity of liquid Q2 along the path W is that the circulated quantity of liquid Q2 does not cool off through contact with the cold items to be washed in the crockery baskets GK and energy is thus lost unnecessarily, which would increase the overall energy required. Finally, in order to increase the cleaning effect of the washing compartment cleaning program RP, there can be provision for releasing a cleaning agent during the washing compartment cleaning program RP, i.e. before the beginning of the cleaning step R, e.g. by a dispensing device (not shown) being controlled by a control device (not shown) such that it is caused to release a cleaning agent.

If the dishwashing machine GS has a dispenser drawer (not shown) assigned to a crockery basket for example in which a cleaning agent is to be dissolved, there can be provision, even during the washing compartment cleaning program RP through explicit activation of the lower spray arm US or of the upper spray arm OS, to bring about the dissolving of the cleaning agent, provided it is possible to apply liquid to the dispensing drawer by operating the lower spray arm US or the upper spray arm OS. As an alternative the cleaning agent can be dissolved only at the beginning of the cleaning step R, so that in this case the fatty deposits in the washing compartment SB are only removed during the washing compartment cleaning program RP essentially by the mechanical cleaning effect of the heated washing liquor.

To carry out the subsequent step of cleaning R the quantity of liquid Q1 present in the dishwashing machine GS is filled up by refilling from a reservoir tank (not shown) of the dishwashing machine GS or by taking it from a domestic supply network until the quantity Q2 is reached. Subsequently, by simultaneous and/or alternating operation of the lower spray arm US, of the upper spray arm OS and/or the shower head DB, water with added cleaning agent is applied to the items to be washed in the crockery baskets GK. Further heating up of the quantity of water Q2 in order to achieve an optimum cleaning effect is not required since a mixing temperature of around 45° C. to 55° C. is produced by the mixing temperature of the liquid quantity Q1, which is heated up to 80° C. for example and the refilled difference quantity up to the quantity of liquid Q2. Thus the energy expended during the washing compartment cleaning program RP for cleaning the washing compartment SB is reused for heating up the quantity of liquid Q1 in the cleaning step R so that the energy requirement overall is reduced.

In the present exemplary embodiment this is followed by the step intermediate rinsing Z, for which the dishwashing machine GS is filled with fresh water once again and the liquid is applied to the items to be cleaned by operating the lower spray arm US, the upper spray arm OS and/or the shower head DB. Subsequently the final rinsing step K is performed during which, likewise by operating the lower spray arm US, the upper spray arm OS and/or the shower head DB, the cleaned items have water applied to them to which rinsing agent acting as a wetting agent has been applied, before in a final drying step T they are dried and can be removed from the crockery baskets GK.

LIST OF REFERENCE CHARACTERS

ABI First section
ABII Second section
DB Shower head
DE Roof
GK Crockery basket
GS Dishwashing machine
K Final rinsing
PS Pump sump
R Cleaning
RP Washing compartment cleaning program
RW Rear wall
S Filter
SW Side wall
T Drying
UP Circulation pump
V Pre-rinsing
W Path
WW Water switch
Z Intermediate rinsing

The invention claimed is:

1. A household dishwashing machine, comprising:

a washing compartment for accommodating items to be cleaned, and a control device having stored therein a cleaning program causing the dishwashing machine to clean the items to be cleaned, at least during a pre-rinsing step and/or a cleaning step with added cleaning agent, wherein the cleaning program is set to operate at an item cleaning temperature that is insufficient to remove fat deposits from at least one inner wall of the washing compartment, and a dishwasher compartment cleaning program causing the dishwashing machine to apply liquid at a compartment cleaning temperature, wherein the compartment cleaning temperature is higher than the item cleaning temperature and is sufficient to remove fat deposits from the at least one inner wall of the washing compartment, and wherein the liquid applied during the dishwasher compartment cleaning program substantially by-passes the items to be cleaned.

2. The household dishwashing machine of claim 1, wherein the dishwasher compartment cleaning program is a part of a wash program comprising the at least one pre-rinsing step and the cleaning step with the added cleaning agent.

3. The household dishwashing machine of claim 2, wherein the washing compartment cleaning program is executed before the at least one pre-rinsing step and cleaning step.

4. The household dishwashing machine of claim 3, wherein the added cleaning agent is dissolved during the washing compartment cleaning program.

5. The household dishwashing machine of claim 3, wherein the added cleaning agent is dissolved after the washing compartment cleaning program.

6. The household dishwashing machine of claim 1, wherein the washing compartment comprises a roof, and a first section extending substantially parallel to the roof and defining a path to at least temporarily guide a liquid circulated during the washing compartment cleaning program.

7. The household dishwashing machine of claim 6, wherein the washing compartment comprises a second section essentially extending along at least one of side walls, a rear wall and an inner door of the washing compartment, the second section defining a path to at least temporarily guide a liquid circulated during the washing compartment cleaning program.

8. The household dishwashing machine of claim 1, further comprising a plurality of spray devices for applying a liquid to items to be washed, wherein an uppermost spray device is operated during the washing compartment cleaning program.

9. The household dishwashing machine of claim 8, wherein the uppermost spray device is embodied as a shower head.

10. The household dishwashing machine of claim 1, wherein a first quantity of liquid is circulated during the washing compartment cleaning program and a second quantity of liquid is circulated during the cleaning step, with the first quantity of liquid being smaller than the second quantity of liquid.

11. The household dishwashing machine of claim 10, wherein the first quantity of liquid is circulated at least temporarily at a higher first pressure than the second quantity of liquid which is circulated at a second lower pressure.

12. The household dishwashing machine of claim 1, further comprising a circulation pump for circulating liquid constructed for operation at a high speed at least during part of the washing compartment cleaning program and at a low speed at least during part of the at least one pre-rinsing step and cleaning step.

13. The household dishwashing machine of claim 1, wherein a first quantity of liquid is heated up during the washing compartment cleaning program to a first maximum temperature which is higher than a second maximum temperature to which a second quantity of the liquid is heated during the at least one pre-rinsing step and cleaning step.

14. The household dishwashing machine of claim 13, wherein a temperature difference between the first maximum temperature and the second maximum temperature is between about 5° C. and about 50° C.

15. The household dishwashing machine of claim 14, wherein a temperature difference between the first maximum temperature and the second maximum temperature is between about 10° C. and about 25° C.

16. The household dishwashing machine of claim 13, wherein the first quantity of liquid is a part of the second quantity of liquid.

17. The household dishwashing machine of claim 1, further comprising a spraying device associated with the dishwasher compartment cleaning program, the spraying device being configured to direct liquid along a path that is parallel to the at least one inner wall of the washing container.

18. The household dishwashing machine of claim 17, wherein the path extends substantially parallel to a roof wall of the washing compartment, and extends substantially parallel to side walls of the washing compartment.

19. The household dishwashing machine of claim 1, further comprising a spraying device associated with the dishwasher compartment cleaning program, the spraying device being configured to direct liquid along the at least one inner wall of the washing compartment while substantially by-passing the items to be cleaned.

20. The household dishwashing machine of claim 1, wherein the item cleaning temperature is about 50° C.

21. The household dishwashing machine of claim 1, wherein the item cleaning temperature is not more than about 50° C. and the compartment cleaning temperature is about 60° C.-80° C.

22. A method for operating a household dishwashing machine, comprising:

arranging items to be washing in a washing compartment, cleaning the items in at least one of a pre-rinsing step and a cleaning step with addition of a cleaning agent, wherein at least one of the pre-rinsing step and the cleaning step operate at an item cleaning temperature that is insufficient to remove fat deposits from at least one inner wall of the washing compartment, executing a washing compartment cleaning program causing the dishwashing machine to apply liquid at a washing compartment cleaning temperature, wherein the washing compartment cleaning temperature is greater than the item cleaning temperature and is sufficient to remove fat deposits from the at least one wall in the washing compartment, and wherein the liquid applied during the washing compartment cleaning program substantially by-passes the items to be washed.

23. The method of claim 22, wherein the washing compartment cleaning program is executed as a part step of a washing program additionally comprising the at least one pre-rinsing step and cleaning step with addition of the cleaning agent.

24. The method of claim 23, wherein the washing compartment cleaning program is executed before the at least one pre-rinsing step and cleaning step.

25. The method of claim 23, wherein the cleaning agent is dissolved during the washing compartment cleaning program.

26. The method of claim 23, wherein the cleaning agent is dissolved after the washing compartment cleaning program.

27. The method of claim 22, wherein the liquid circulated during the washing compartment cleaning program is guided at least temporarily along a path which extends along the a first section essentially parallel with a roof of the washing compartment.

28. The method of claim 22, wherein the liquid circulated during the washing compartment cleaning program is guided at least temporarily along a path which extends along a second section essentially along at least one of sidewalls, a rear wall and an inner door of the washing compartment.

29. The method of claim 22, further comprising applying liquid to the items to be washed with a plurality of spray devices arranged at a number of levels, with an uppermost spray device being operated during the washing compartment cleaning program.

30. The method of claim 29, wherein the uppermost spray device is used as a shower head.

31. The method of claim 22, further comprising circulating during the washing compartment cleaning program a first quantity of liquid, and circulating during the cleaning step a second quantity of liquid, with the first quantity of liquid being smaller than the second quantity of liquid.

32. The method of claim 31, wherein the first quantity of liquid is at least temporarily circulated at a first pressure which is higher than second pressure at which the second quantity of the liquid is circulated.

33. The method of claim 22, further comprising operating a circulation pump for circulating liquid at least at a high-speed and at a low speed, wherein the circulation pump is operated at least temporarily during the washing compartment cleaning program at the high-speed and at least temporarily during the at least one pre-rinsing step and cleaning step at the low speed.

34. The method of claim 22, wherein during the washing compartment cleaning program, a first quantity of liquid is heated up to a first maximum temperature which is higher than a second maximum temperature to which a second quantity of liquid is heated up during the at least one pre-rinsing step and cleaning step.

35. The method of claim 34, wherein a temperature difference between the first maximum temperature and the second maximum temperature is between about 5° C. and about 50° C.

36. The method of claim 34, wherein a temperature difference between the first maximum temperature and the second maximum temperature is between about 10° C. and about 25° C.

37. The method of claim 31, wherein the first quantity of liquid is part of the second quantity of liquid.

* * * * *

UNITED STATES PATENT AND TRADEMARK OFFICE

CERTIFICATE OF CORRECTION

PATENT NO. : 9,320,410 B2
APPLICATION NO. : 13/260576
DATED : April 26, 2016
INVENTOR(S) : Daniel Delle It is certified that error appears in the above-identified patent and that said Letters Patent is hereby corrected as shown below:

TITLE PAGE

Insert --(30) Foreign Application Priority Data
April 2, 2009 (DE).....10 2009 002 147.7--

Signed and Sealed this
Twenty-first Day of June, 2016

Michelle K. Lee

Michelle K. Lee
*Director of the United States Patent and Trademark Office*